US006082455A

United States Patent [19]

Pringle et al.

[11] Patent Number: 6,082,455

[45] Date of Patent: Jul. 4, 2000

[54] COMBINATION SIDE POCKET MANDREL FLOW MEASUREMENT AND CONTROL ASSEMBLY

[75] Inventors: Ronald E. Pringle, Houston; James Réaux, Brookshire, both of Tex.

[73] Assignee: Camco International Inc., Houston, Tex.

[21] Appl. No.: 09/112,030

[22] Filed: Jul. 8, 1998

[51] Int. Cl.[7] ..... E21B 47/00

[52] U.S. Cl. ..... 166/250.15; 166/168; 166/322; 166/372; 166/375

[58] Field of Search ..... 166/72, 168, 184, 166/250.15, 319, 322, 373, 374, 375

[56] References Cited

U.S. PATENT DOCUMENTS 4,105,279 8/1978 Glotin et al. .
5,033,550 7/1991 Johnson et al. ..... 166/117.5
5,172,717 12/1992 Boyle et al. ..... 137/155
5,318,130 6/1994 Manke .
5,501,279 3/1996 Garg et al. ..... 166/168 X
5,730,219 3/1998 Tubel et al. .
5,736,650 4/1998 Hiron et al. .

*Primary Examiner*—Roger Schoeppel
*Attorney, Agent, or Firm*—Tabor, Goldstein & Healey, L.L.P.

[57] ABSTRACT

The present invention is a combination wireline retrievable, side pocket locatable, fluid measurement and control assembly, which permits measurement and control of fluid from a first downhole production zone while maintaining fluid flow through the tubing from other downhole production zones. The various components of the fluid measurement and control assembly may be separately installed in or retrieved from by either wireline or coiled tubing intervention methods and can remain installed in the production tubing while installing or retrieving other downhole tools through wireline or coiled tubing intervention methods.

45 Claims, 13 Drawing Sheets

COMBINATION SIDE POCKET MANDREL FLOW MEASUREMENT AND CONTROL ASSEMBLY

BACKGROUND OF THE INVENTION

1. Field of the Invention

This invention relates generally to a downhole fluid flow measurement and control system for the control of oil and gas production wells. More particularly, the invention relates to a combination side pocket mandrel assembly with both a wireline retrievable venturi flow measurement device and a wireline retrievable flow control device adapted to be retrievably located in side pockets of one or more side pocket mandrels in a string of tubing.

2. Description of the Related Art

The present invention constitutes an improvement over prior downhole fluid measurement and control devices for the control of oil and gas production wells. Measurement and control of various downhole fluid flow parameters may be desirable in particular oil and gas production wells. Various apparatus and systems have been devised to measure such parameters as fluid flow rate, fluid pressure, and fluid composition of both production fluid and other fluids which may be introduced into a production formation such as gas injected for artificial gas lift of the production fluid. Prior systems have measured flow rate, for example, by use of a venturi flow meter located in downhole tubing by wireline or other conventional methods to measure the differential pressures within a venturi to determine the rate of fluid flow within the tubing. In response to signals from microprocessors connected to such measurement devices, prior systems have actuated downhole control systems to control downhole fluid flow within the production tubing such as by conventional downhole sliding sleeve tools or by electrically or hydraulically controlled subsurface flow valves.

Prior measurement and control systems have located either of the fluid measurement or control devices in the central tubing bore or in the side pocket of a side pocket mandrel to permit wireline retrieval of those devices. However, prior systems are limited in that either the measurement device, the control device, or both remained in the central bore of the production tubing, thus preventing wireline retrieval of tools downhole of the measurement and control system while the measurement and control system is operating and preventing measurement and control of production fluid or other fluids in discrete production zones of a multiple completion production well.

Accordingly, there has developed a need to provide a combination wireline retrievable side pocket locatable downhole fluid measurement and control system. The present invention may overcome one or more of the shortcomings that may be present in prior downhole fluid measurement and control systems.

SUMMARY OF THE INVENTION

The present invention has been contemplated to overcome the foregoing deficiencies and meet the above described needs. In one aspect, the present invention is a combination wireline retrievable, side pocket locatable, downhole fluid measurement and control assembly, comprising: a fluid measurement device, adapted to be retrievably located downhole within at least one side pocket bore of at least one side pocket mandrel connected to a length of downhole production tubing; and a fluid control device, adapted to be operably connected and responsive to the fluid measurement device and at least a portion of the fluid control device is also adapted to be retrievably located downhole within at least one side pocket bore of at least one side pocket mandrel. The fluid measurement device may include a flow rate measurement device for measurement of the rate of fluid flow within the length of downhole production tubing and the flow measurement device may include a venturi. The flow measurement device may also include a differential pressure transducer; and the venturi may be locatable within a first side pocket bore of at least one side pocket mandrel and the differential pressure transducer may be locatable in a second side pocket bore of the side pocket mandrel. The flow measurement device may further include a static pressure transducer locatable within a third side pocket bore of the at least one side pocket mandrel, and the fluid control device may include a variable orifice valve, which may include an actuating means connected to the variable orifice valve.

In another aspect, the present invention is a combination wireline retrievable, side pocket locatable, downhole fluid measurement and control system, comprising: a first side pocket mandrel, connected to a length of downhole production tubing; a second side pocket mandrel, connected to the length of downhole production tubing; a wireline retrievable fluid measurement device, disposed within at least one side pocket bore of the first side pocket mandrel; a fluid control device, disposed within at least one side pocket bore of the second side pocket mandrel and at least a portion of the fluid control device being wireline retrievable; and a flow conduit connected to and in fluid communication between the fluid control device and the fluid measurement device. The fluid measurement device may include a flow rate measurement device for measurement of the rate of fluid flow within the length of downhole production tubing; and the flow measurement device may include a venturi and a differential pressure transducer. The venturi may be locatable within a first side pocket bore of at least one side pocket mandrel and the differential pressure transducer may be locatable in a second side pocket bore of the side pocket mandrel. The flow measurement device may further include a static pressure transducer locatable within a third side pocket bore of the at least one side pocket mandrel, and the fluid control device may include a variable orifice valve. The fluid control device may further include an actuating means connected to the variable orifice valve. The first and second side pocket mandrel may be integrally formed within a single downhole tool and the flow conduit may include at least one straightening vane provided inline therewith.

In still another aspect, the present invention is a method of measuring and controlling the rate of fluid flow within a length of downhole production tubing having a central bore, comprising the steps of: providing at least a first side pocket mandrel and a second side pocket mandrel within the length of downhole production tubing, each first and second side pocket mandrel having at least a central bore, a first side pocket bore, and a second side pocket bore; providing a flow conduit between the first and second side pocket mandrel; providing a fluid flow measurement device within at least one of the first or second side pocket bores of the first side pocket mandrel and in fluid communication with the flow conduit; providing a fluid control device within at least one of the first or second side pocket bores of the second side pocket mandrel and in fluid communication with both the flow conduit; measuring the fluid flow rate with the fluid flow measurement device; generating a control signal in response to the fluid flow rate; and, in response to the control signal, controlling the flow through the fluid control device.

The fluid measurement device may be in fluid communication with the central bore of the production tubing and the fluid control device may be in fluid communication with a production formation. The fluid measurement device may include a venturi and the fluid control device may include a variable orifice valve. The fluid measurement device may further include a differential pressure transducer in fluid communication with the venturi and the fluid measurement device may further include a static pressure transducer. The fluid control device may further include a power source operably connected to the variable orifice valve for selectively varying the orifice size of the variable orifice valve in response to the control signal.

In still another aspect, the present invention is a combination wireline retrievable, side pocket locatable, downhole fluid measurement and control system, comprising: a first side pocket mandrel, connected to a length of downhole production tubing; a second side pocket mandrel, connected to the length of downhole production tubing; a wireline retrievable venturi, disposed within a first side pocket bore of the first side pocket mandrel; a wireline retrievable differential pressure transducer, disposed within a second side pocket bore of the first side pocket mandrel; a wireline retrievable static pressure transducer, disposed within a third side pocket bore of the first side pocket mandrel; a wireline retrievable variable orifice valve, having at least an open and closed position and being disposed within a second side pocket bore of the second side pocket mandrel and in fluid communication with a production formation; a power source, disposed within a third side pocket bore of the second side pocket mandrel; a flow conduit, disposed within a first side pocket bore in fluid communication between the venturi and the variable orifice valve; and the venturi being in fluid communication with the central bore of the production tubing and in fluid communication with the differential pressure transducer, whereby, when the variable orifice valve is in its open position, fluid flow between the central bore of the production tubing and the production formation must flow through the variable orifice valve, through the flow conduit, through the venturi, and into the central bore of the production tubing.

In yet another aspect, the present invention is a method of measuring and controlling, in a string of tubing in a well bore, a first fluid flow rate associated with fluid in a first downhole region, while maintaining, in the string of tubing, a second fluid flow rate associated with a second downhole region, comprising the steps of: providing a wireline retrievable, side pocket locatable, fluid measurement and control assembly; connecting the fluid measurement and control assembly to the string of tubing proximate a length of the string of tubing associated with the first downhole region; providing a first packer, positioned about the length of tubing uphole of the first downhole region; providing a second packer, positioned about the length of tubing downhole of the first downhole region, whereby an annulus region is formed between the first and second packer; permitting fluid flow through a central bore of the tubing at a length of the tubing associated with the second downhole region; measuring and controlling the fluid flow from the first downhole region into the annulus region and through the fluid measurement and control assembly independent from the flow through the tubing from the second downhole region; and permitting fluid flow from the fluid measurement and control assembly to flow through the central bore of the tubing. The first downhole region may be a desired producing geological formation and the second downhole region may be a desired producing geological formation; or the first downhole region may be associated with a gas lift conduit, the annulus region being a non-producing gas lift annulus region, and the second downhole region may be a desired producing geological formation.

BRIEF DESCRIPTION OF THE DRAWINGS

FIGS. 6, 7A–7J are elevation views which together illustrate an embodiment of the fluid measurement and control assembly of the present invention taken along line 7A–7J of FIG. 6.

Figure 1:
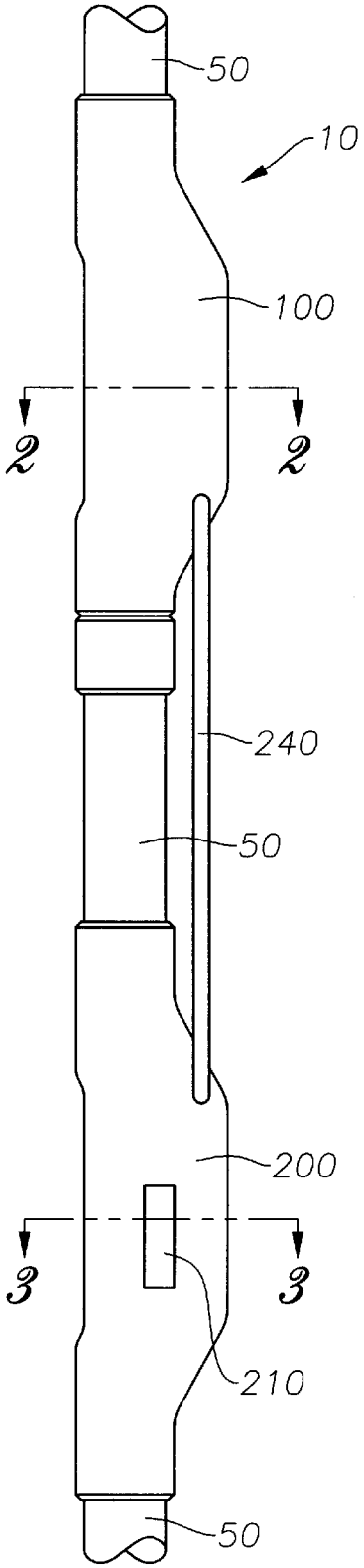
FIG. 1 is an elevation view which illustrates a first and second side pocket mandrel, separated with a length of tubing and showing a flow conduit therebetween.
Figure 2:
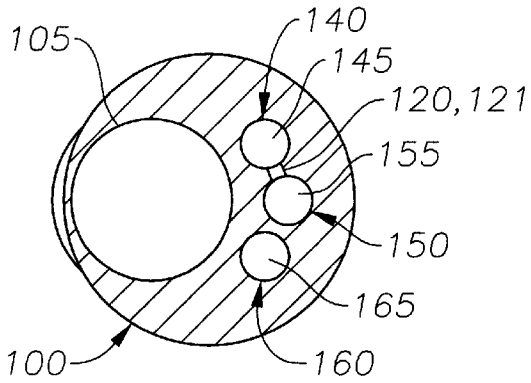
FIG. 2 is a cross-sectional view taken along line A—A of FIG. 1A.
Figure 3:
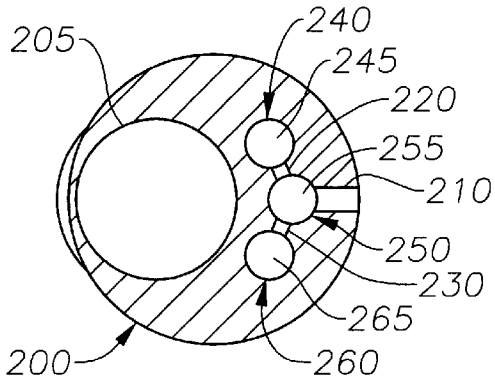
FIG. 3 is a cross-sectional view taken along line B—B of FIG. 1B.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DESCRIPTION OF THE PREFERRED EMBODIMENTS

In the description that follows, like parts are marked through the specification and drawings with the same reference numerals, respectively. The figures are not necessarily drawn to scale, and in some instances, have been exaggerated or simplified to clarify certain features of the invention. One skilled in the art will appreciate many differing applications of the described apparatus.

For the purposes of this discussion, the terms "upper" and "lower," "up hole" and "downhole," and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

Figure 4:
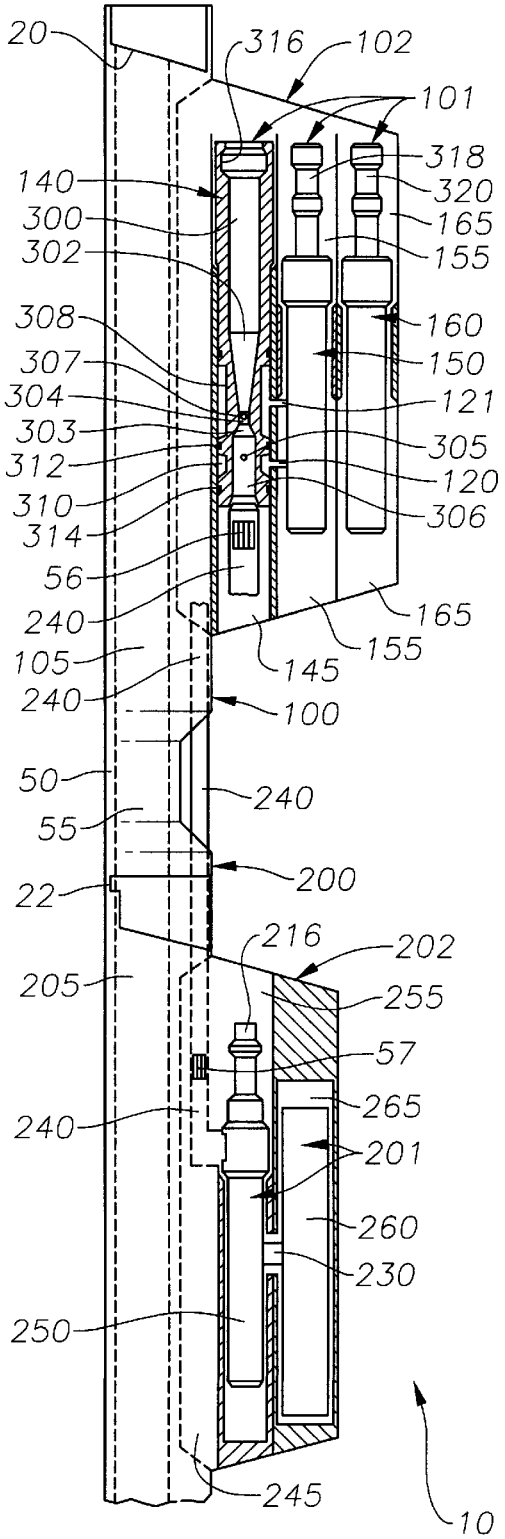
FIG. 4 is an elevation view, which illustrates an embodiment of the fluid control and measurement assembly of the present invention; the components are shown rotated ninety degrees for clarity.

Referring to FIG. 1, a length of downhole production tubing 50 is shown having first side pocket mandrel 100 and second side pocket mandrel 200 connected thereto. It should be noted at the outset that, in a particular embodiment, first side pocket mandrel 100 and second side pocket mandrel 200 may be discrete mandrels, joined by a length of production tubing 50, or they may be integrated in a single tool (FIGS. 6, 7A–7J). Reference to a first and second side pocket mandrel 100, 200, shall refer to either configuration unless specifically stated to the contrary. As shown in FIG. 4, first side pocket mandrel 100 may include a central bore 105 for communication of production fluid and other fluids through first side pocket mandrel 100 into the central bore 55 of the length of production tubing 50. As further shown in FIG. 4, first side pocket mandrel 100 may further include a plurality of side pocket bores, which may include first side pocket bore 145, second side pocket bore 155, and third side pocket bore 165. As shown in FIG. 4, second side pocket mandrel 200 may also further include a plurality of side pocket bores, which may include first side pocket bore 245, second side pocket bore 255, and third side pocket bore 265. Referring again to FIG. 1, a flow conduit 240 may be provided between first side pocket mandrel 100 and second side pocket mandrel 200 for delivery of the fluid to be measured and/or controlled between first side pocket mandrel 100 and second side pocket mandrel 200.

Referring again to FIG. 4, first side pocket mandrel 100 and second side pocket mandrel 200 are shown in more detail as used in the combination wireline retrievable, side pocket locatable, downhole fluid measurement and control assembly 10 of the present invention. The measurement and control assembly 10 of the present invention generally includes fluid measurement device 101, which is adapted to be retrievably located downhole within at least one side pocket 102 of first side pocket mandrel 100, which is shown connected to a length of downhole production tubing 50. The measurement and control assembly 10 of the present invention also generally includes fluid control device 201, which is adapted to be operably connected and responsive to fluid measurement device 101. At least a portion of the fluid control device 201 is also adapted to be retrievably located downhole within at least one side pocket bore 245,255,265 of at least one side pocket 202 of second side pocket mandrel 200. It should be noted that fluid measurement device 101 may be disposed within a single side pocket mandrel 100 (as shown), or it may be disposed within a plurality of side pocket mandrels (not shown). Similarly, fluid control device 201 may be disposed within a single side pocket mandrel 200 (as shown), or it may also be disposed within a plurality of side pocket mandrels (not shown).

Fluid measurement device 101 may comprise a venturi 140, a differential pressure transducer 150, and a static pressure transducer 160, which components 140, 150, 160 may be separate and individually locatable within and retrievable from a plurality of side pocket bores (as shown) by conventional wireline techniques; or they may be integrated into a single unit (not shown). Further, venturi 140 may be a first separate device, with differential pressure transducer 150 and static pressure transducer 160 being integrated into a second separate device (not shown). The individual components 140, 150, 160 of fluid measurement device 101 may be individually locatable within and retrievable from a plurality of side pocket bores 145, 155, 165 in a single side pocket mandrel 100 (as shown), or any of the components 140, 150, 160 may be locatable within and retrievable from side pocket bores of discrete side pocket mandrels (not shown). In a preferred embodiment, wireline locatable and retrievable venturi 140 is shown disposed within first side pocket bore 145 of side pocket mandrel 100. Similarly, wireline locatable and retrievable differential pressure transducer 150 is shown disposed within second side pocket bore 155 of side pocket mandrel 100. Likewise, wireline locatable and retrievable static pressure transducer 160 is shown disposed within third side pocket bore 165 of side pocket mandrel 100. Venturi 140, differential pressure transducer 150, and static pressure transducer 160 are shown having conventional wireline retrieval fittings 316, 318, 320, respectively for locating and retrieving using conventional wireline location and retrieval methods known in the art.

The flow rate is calculated by taking measurement of the fluid as it passes through the venturi 140 or other suitable fluid measurement device. There are a number of methods known in the art that can be used to measure the flow of fluid through a passageway. For example, a turbine could be placed within the passageway to measure the flow rate. Another commonly known device for measuring fluid flow through a passageway is to insert a pivot tube into the passageway and measuring the pressure exerted on the tube by the flow at the opening. As in the embodiment shown, a restricted orifice 304 of a known diameter can be placed in passageway 300 of venturi 140 and differential pressure transducer 150 can be placed in fluid communication with both sides thereof through first pressure port 305 of venturi 140 and through first pressure port 120 of differential pressure transducer 150 to measure the pressure upstream of the orifice 304 and through second pressure port 307 of venturi 140 and through second pressure port 121 of differential pressure transducer 150 to measure the pressure downstream of the orifice 304. From the data gathered using these methods, the flow rate can be calculated. These and other well known methods for measuring flow rates can be used in conjunction with the present invention to obtain the rate of fluid flow through the venturi 140.

According to a preferred embodiment shown, the venturi method of calculating flow rate may be used. According to this method, a venturi 140 of known dimensions is formed in the passageway 300. The flow through the venturi 140 creates a differential pressure which is measured by a transducer such as differential pressure transducer 150 operatively in fluid communication with the venturi 140. Static pressure and temperature transducer 160 may also be provided to measure the static pressure and temperature within the tubing (not shown) to aid in computing the flow rate and for other purposes. Control lines 59 (FIG. 7F) may extend through control conduit 58 provided within side pocket mandrel 100 to connect the differential pressure transducer 150 to a surface controller and monitor (not shown). The control lines 59 may be electric or fiber optic depending upon the type of transducer and controller being used. Because the differential pressure transducer 150 and static pressure transducer 160 may both be wireline retrievable, electrical connection with control lines 59 may be through inductive couplers 75, 75' (FIG. 6), which are well known in the art.

Inductive couplers 75, 75' may include primary coil 76, 76' and secondary coil 77, 77' through which electrical signals may pass through induction. As differential pressure transducer 150 and static pressure transducer 160 are lowered into second side pocket bore 155 and third side pocket bore 165, respectively, primary coil 76, 76' will come into contact with secondary coil 77, 77' thus allowing for transmission of electrical signals without the need for physical connection of control lines 59 with differential pressure transducer 150 or static pressure transducer 160 to facilitate wireline retrieval thereof. Transducers 150, 160 may be typical downhole devices such as quartz or sapphore piezoelectric crystals, true differential pressure devices, such as a bellow, or a stream gauge type device—i.e., a change in stress creates a current which is calibrated in pressure, temperature or differential pressure.

Fluid control device 201 may comprise a variable orifice valve 250 and a power source 260, which components 250, 260 may be separate and individually locatable within and retrievable from a plurality of side pocket bores (as shown) by conventional wireline techniques; or they may be integrated into a single unit (not shown). The individual components 250, 260 of fluid control device 201 may be individually locatable within and retrievable from a plurality of side pocket bores 255, 265 in a single side pocket mandrel 200 (as shown), or any of the components 250, 260 may be locatable within and retrievable from side pocket bores of discrete side pocket mandrels (not shown). In a preferred embodiment, wireline locatable and retrievable variable orifice valve 250 is shown disposed within second side pocket bore 255 of side pocket mandrel 200. Similarly, wireline locatable and retrievable power source 265 is shown disposed within third side pocket bore 265 of side pocket mandrel 200. Variable orifice valve 250 is shown having a conventional wireline retrieval fitting 216. Power source 260 is shown as being permanently located downhole and, therefore, does not show a wireline retrieval fitting; however, it should be noted that, in a particular embodiment, power source 260 may also be wireline retrievable and, accordingly, would have a suitable wireline retrieval fitting.

In a particular embodiment, a single mandrel orienting sleeve 20 may be provided to orient the wireline kickover tool used to locate and retrieve the various components of fluid measurement device 101 and fluid control device 201. In such an embodiment, separate kickover tools having different lengths lengthened by use of a spacer bar, for example, may be used to locate and retrieve such components from within both side pocket mandrels 100,200. In such an embodiment, a single orienting sleeve 20 may be positioned within an upper portion of the central bore 105 of first side pocket mandrel 100. The orienting sleeve 20 may include an upwardly directed helical surface and actuating shoulder for for rotationally orienting a kickover tool for properly any of the components 140, 150, 160 of the fluid measurement device 101 for insertion into or removal from a side pocket 102 of side pocket mandrel 100, or for aligning any of the components 240, 250 of fluid control device 201 for insertion into or removal from a side pocket 102 of side pocket mandrel 100 through use of multiple length kickover tools. In addition, orienting sleeve 20 may further include an actuating shoulder actuating the kickover tool for such installation or removal. The orienting sleeve 20 is preferably secured to the inside of side pocket mandrel 100 by conventional means, such as a weld.

In an alternative embodiment, separate mandrel orienting sleeves 20, 22 may be provided in connection with each of the side pocket mandrels 100,200 so that kickover tools of equal length may be used, without the need for a spacer bar, to locate and retrieve those components from within side pocket mandrels 100, 200, respectively. In such an embodiment, a first orienting sleeve 20 may be positioned within an upper portion of the central bore 105 of first side pocket mandrel 100. The first orienting sleeve 20 may include an upwardly directed helical surface and actuating shoulder for rotationally orienting a kickover tool for properly any of the components 140, 150, 160 of the fluid measurement device 101 for insertion into or removal from a side pocket 102 of side pocket mandrel 100. In addition, orienting sleeve 20 may further include an actuating shoulder for actuating the kickover tool for such installation or removal. A second orienting sleeve 22 may be positioned within an upper portion of the central bore 205 of second side pocket mandrel 200. The second orienting sleeve 22 may include an upwardly directed helical surface and actuating shoulder for actuating the kickover tool for such installation or removal. The orienting sleeve 22 is preferably secured to the inside of side pocket mandrel 200 by conventional means, such as a weld.

It should be noted that side pocket mandrel 100 may be positioned "uphole" or "downhole" of side pocket mandrel 200 and either integrally formed within a single tool (FIGS. 6, 7A–7J) or within discrete tools separated by a segment of production tubing 50 (FIGS. 1, 4) and the separate mandrels 100, 200 may be spaced-apart longitudinally along a line substantially parallel with the production tubing (as shown) or they may be spaced-apart circumferentially from one another around the production tubing (not shown). Accordingly, mandrels 100, 200 may be distinct mandrels (FIGS. 1, 4), having distinct side pockets 102, 202 or the mandrels 100, 200 may be contained within a single oversized mandrel (FIGS. 6, 7A–7J), having side pockets 102, 202 distinguished by the fact that side pocket 102 contains fluid measurement device 101 and side pocket 202 contains fluid control device 202.

Figure 5:
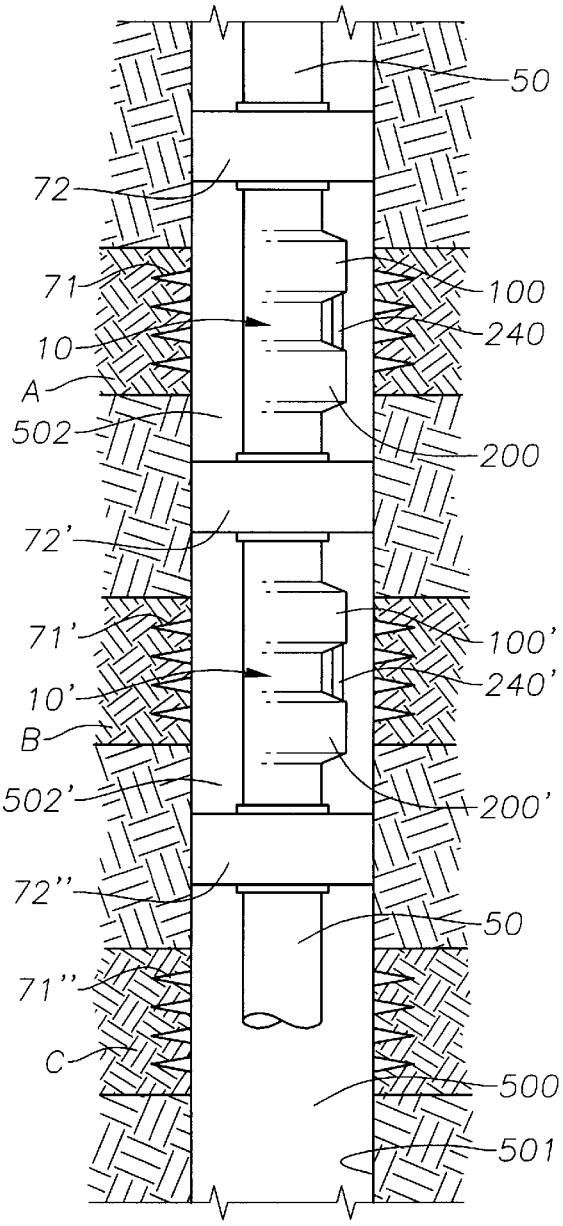
FIG. 5 is a schematic drawing of a well completion system using multiple fluid measurement and control assemblies of the present invention for multiple production zones.
Figure 6:
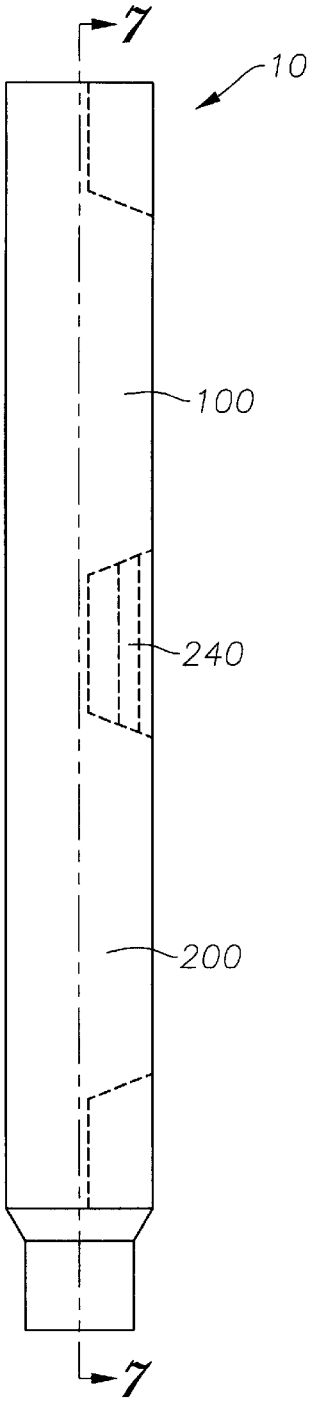
FIGS. 6 is an elevation view of an embodiment of the fluid measurement and control assembly of the present invention having first and second side pocket mandrels integrated in a single tool.
Figure 7A:
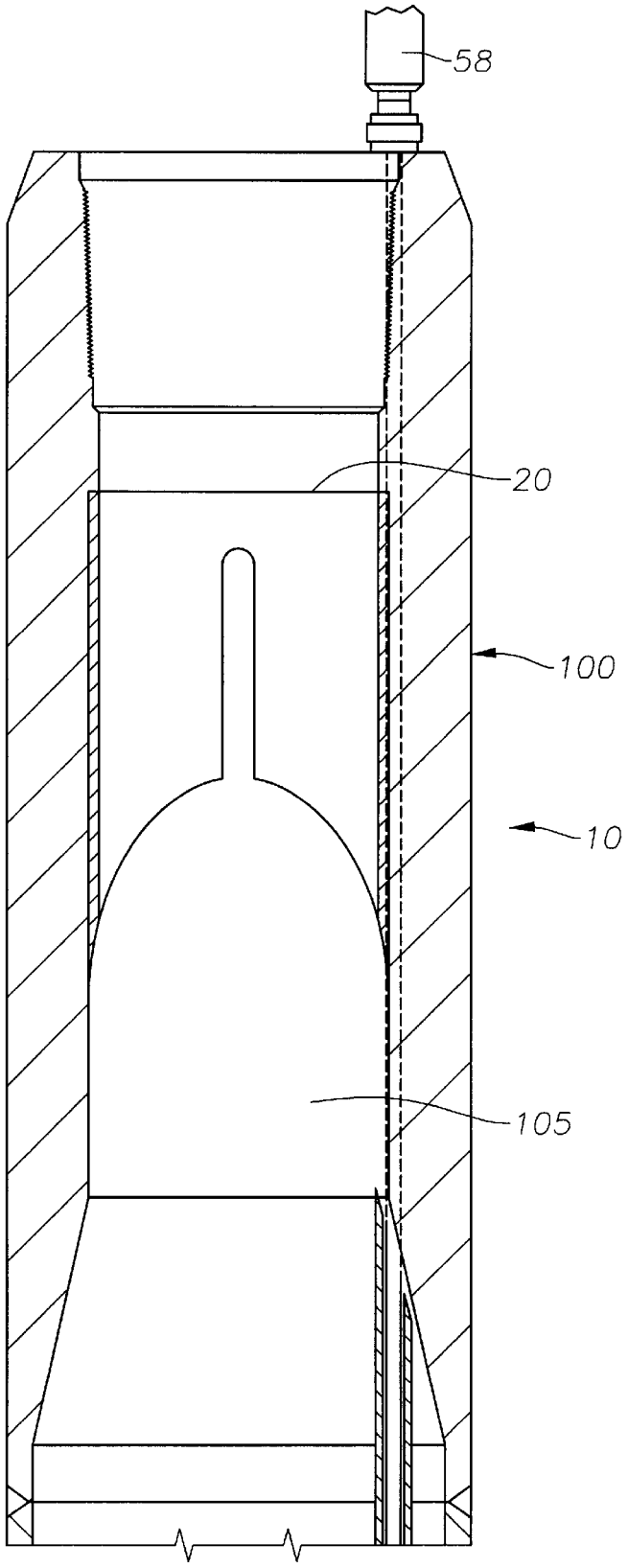
Figure 7B:
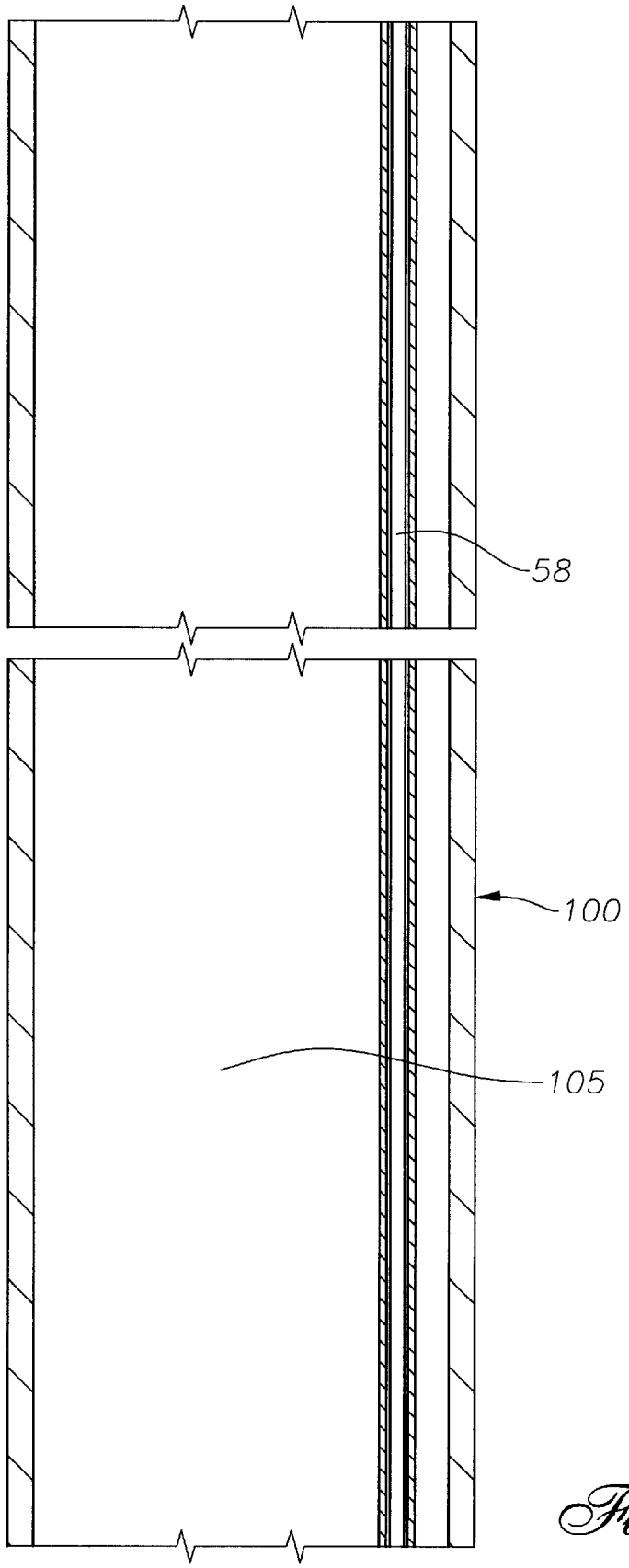
Figure 7C:
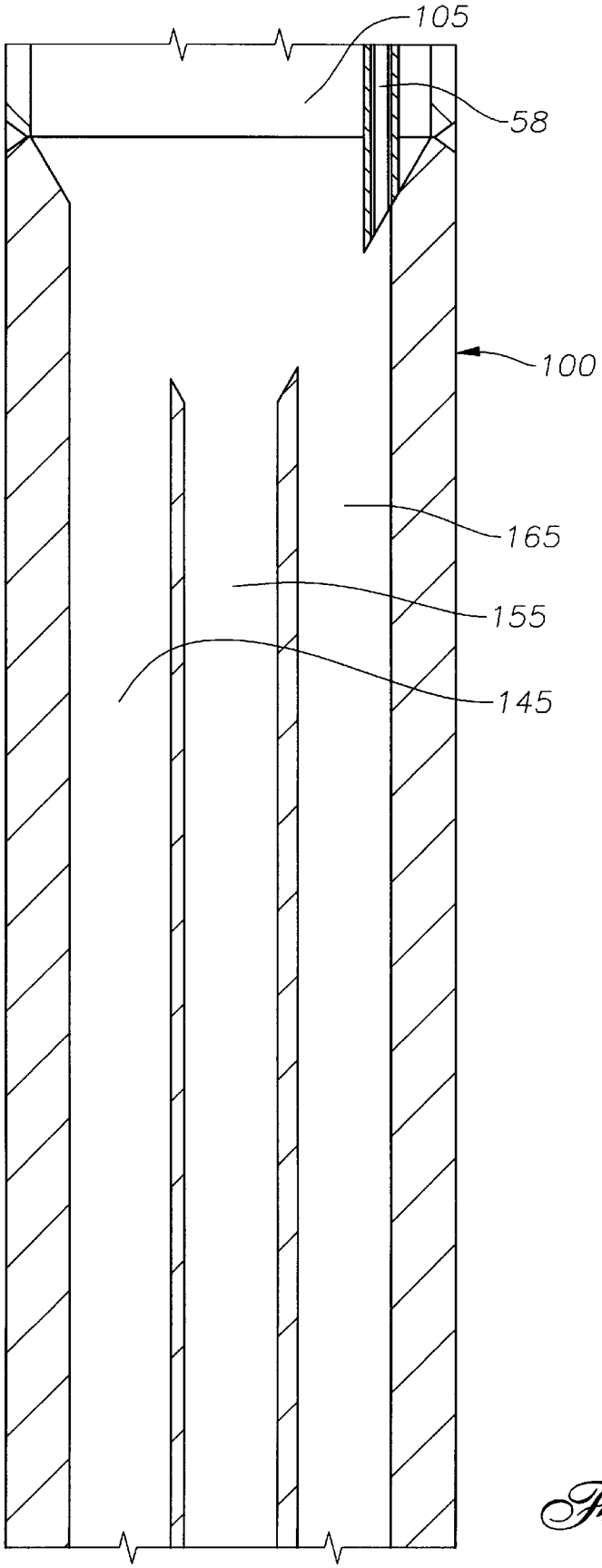
Figure 7D:
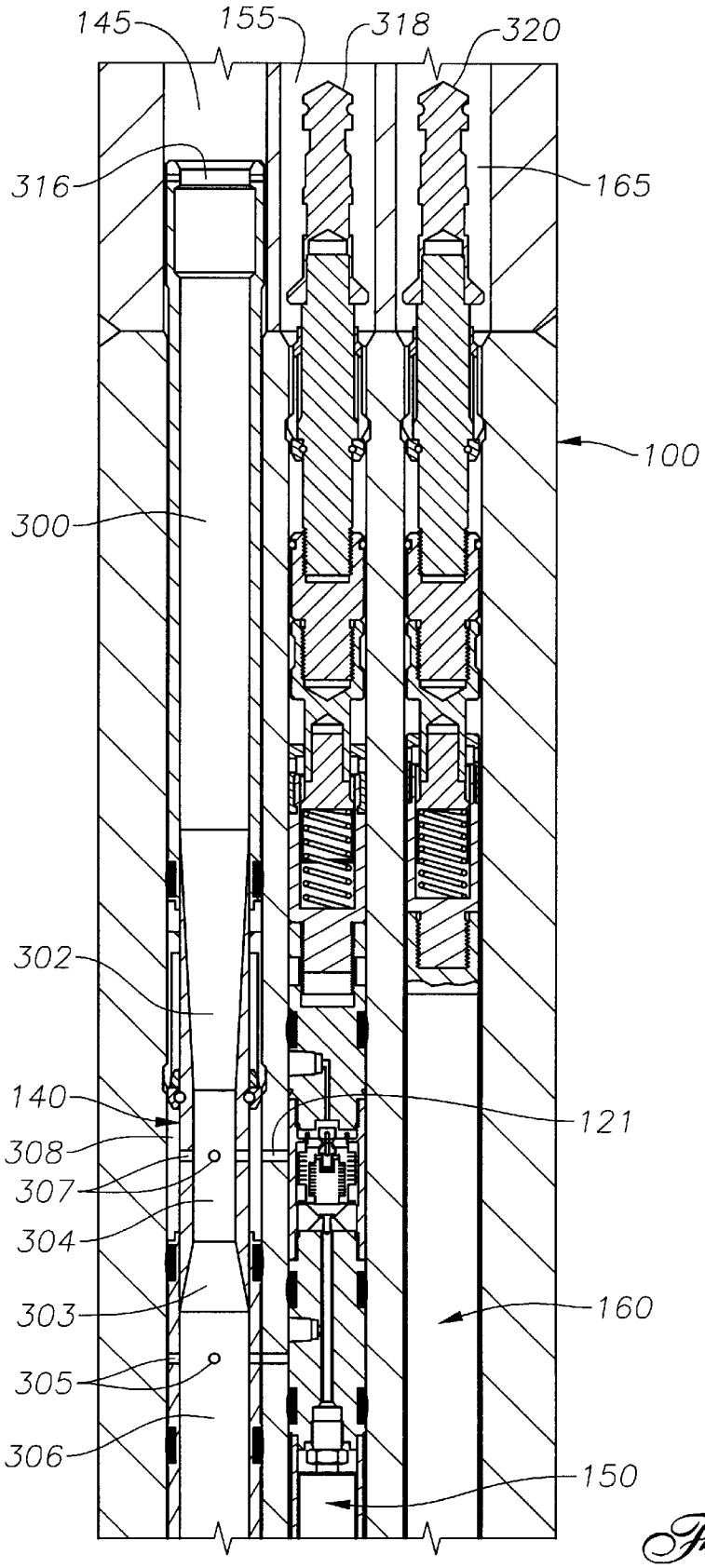
Figure 7E:
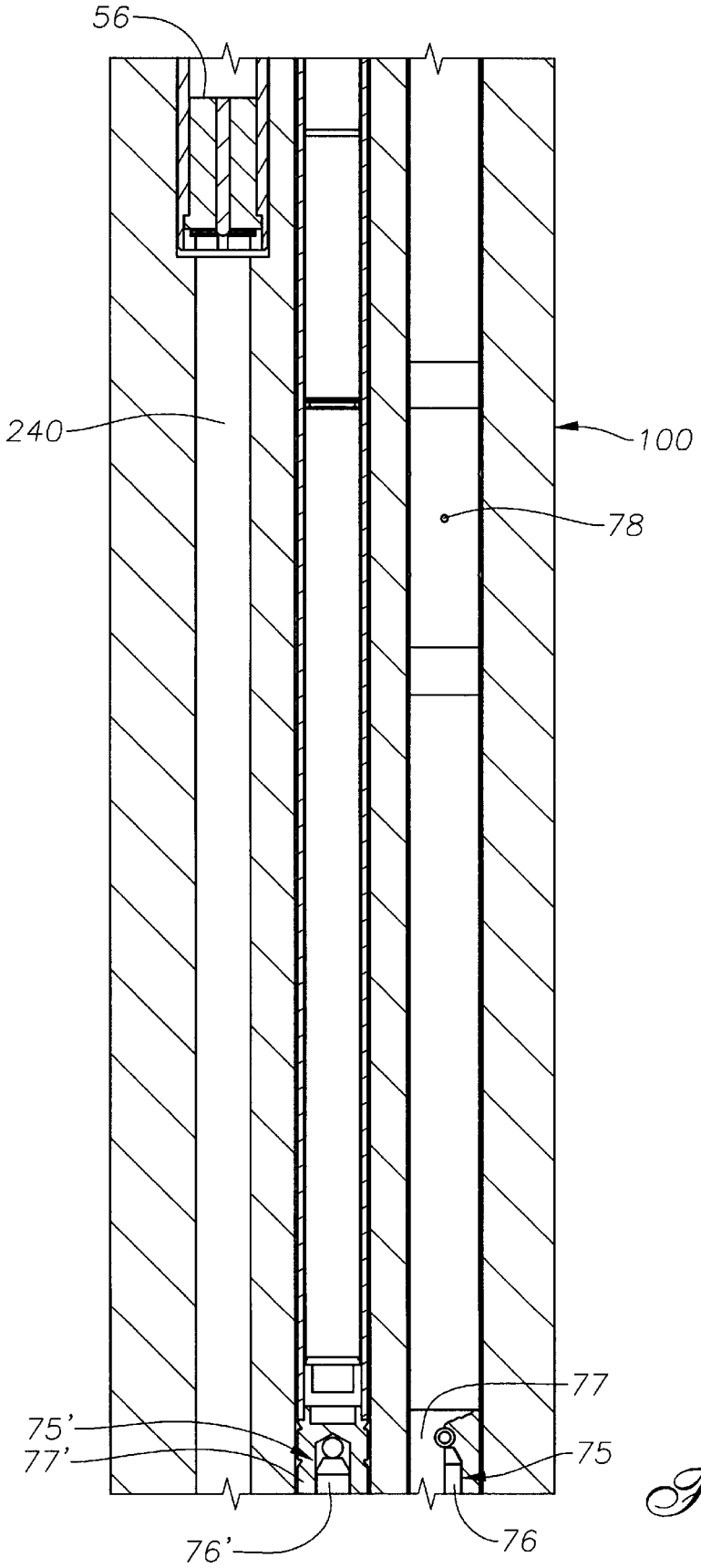
Figure 7F:
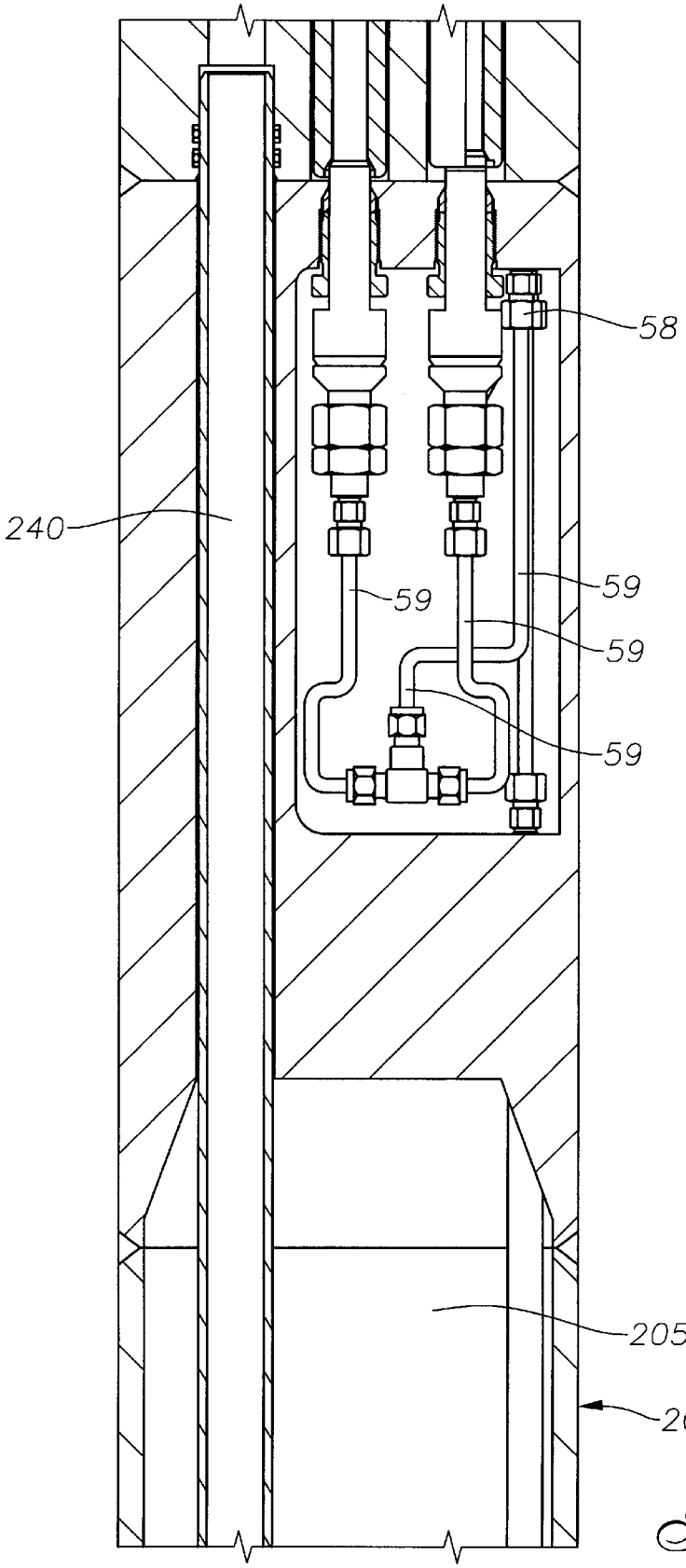
Figure 7G:
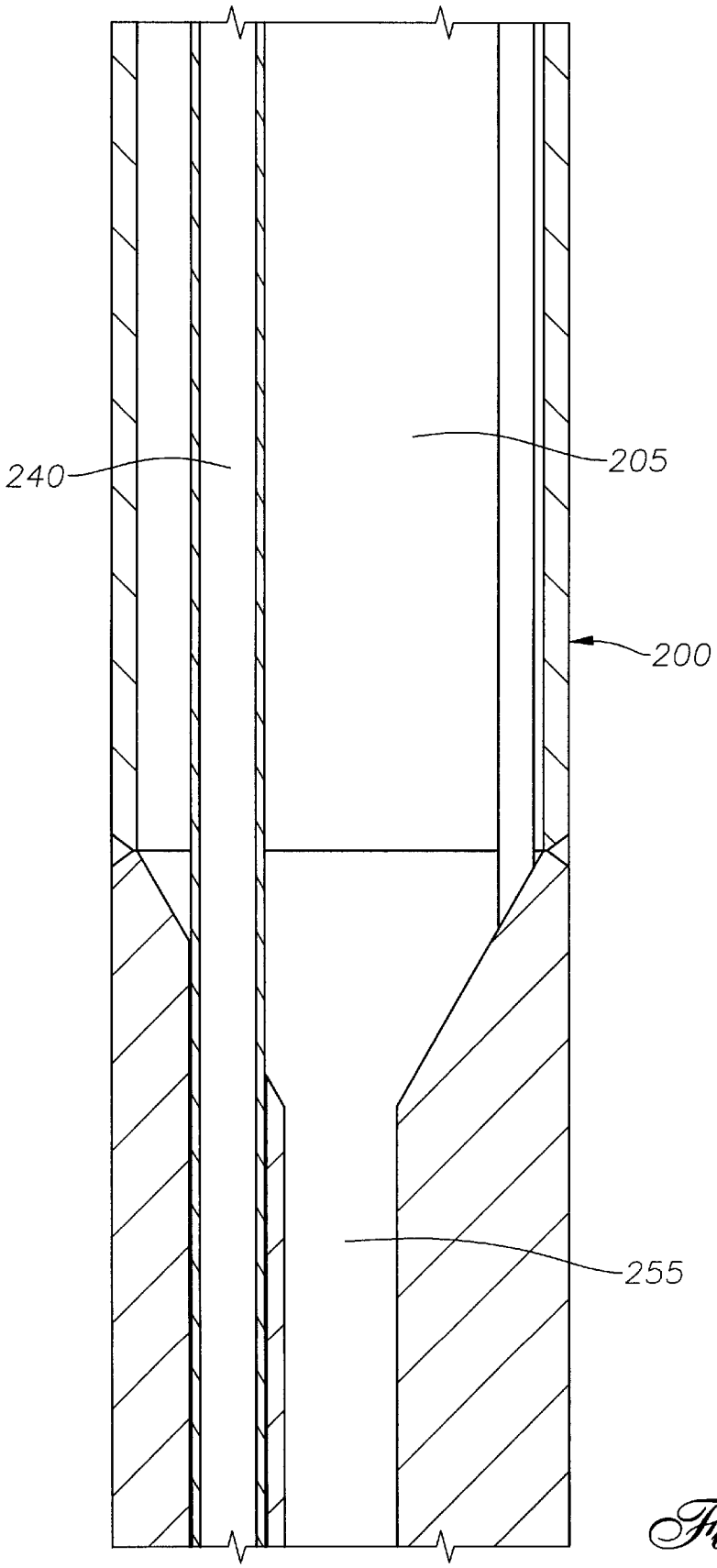
Figure 7H:
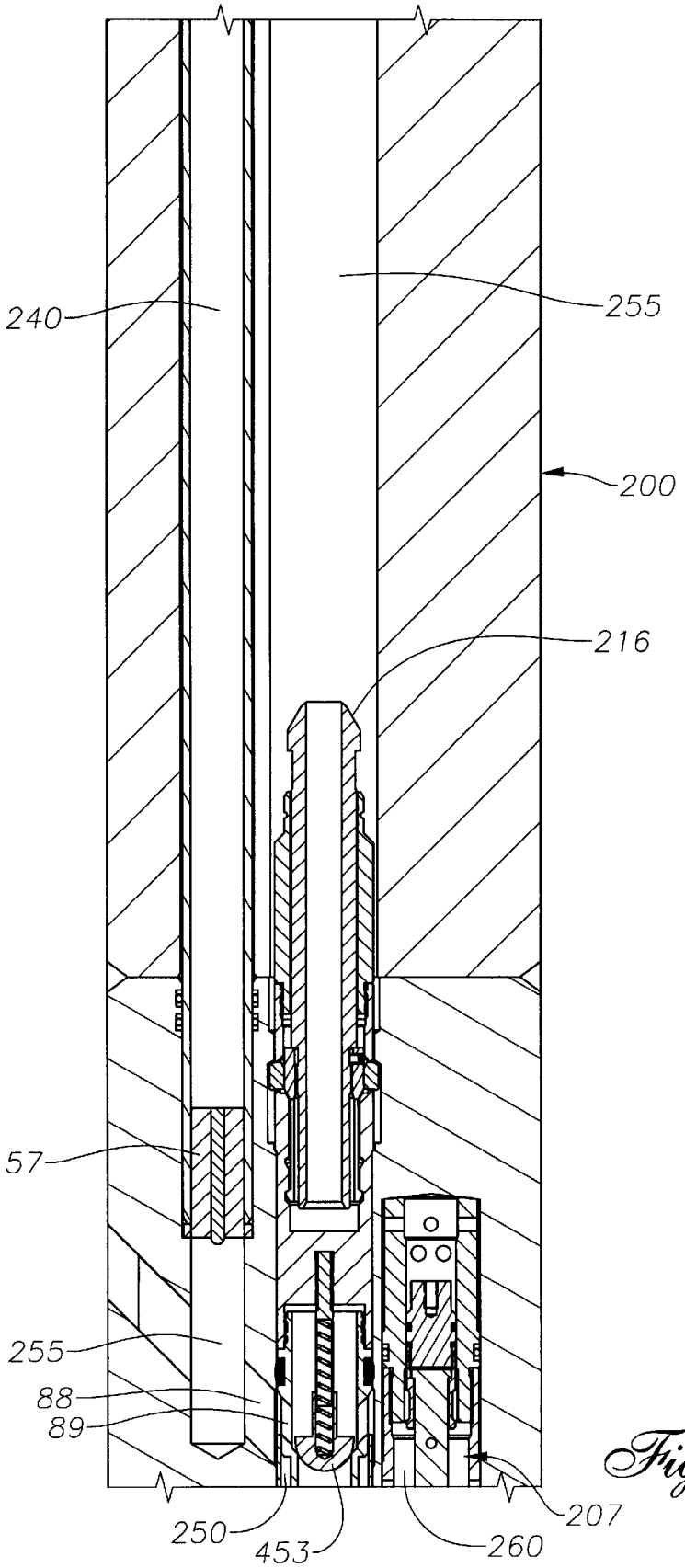
Figure 7J:
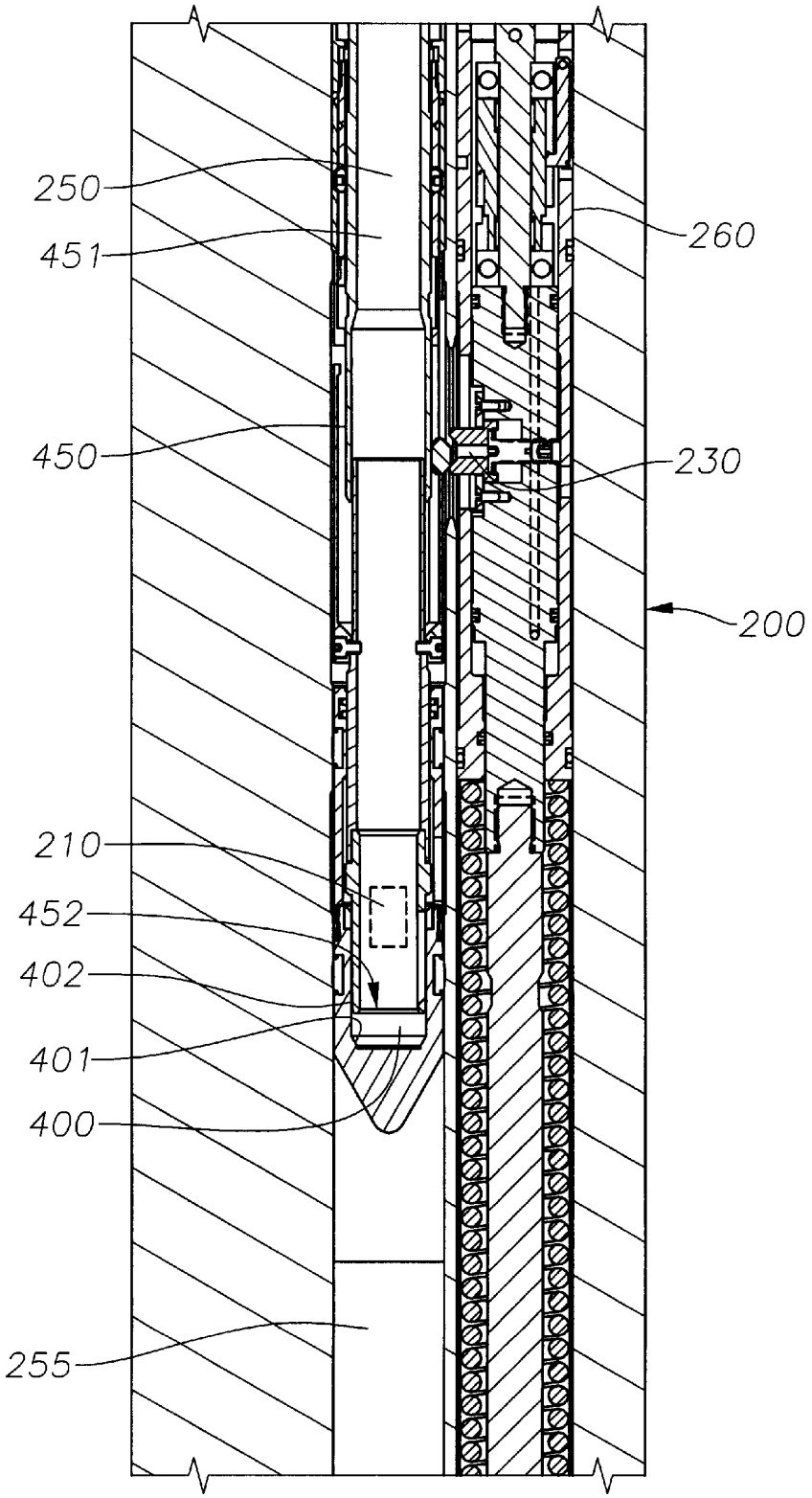
Figure 7J:
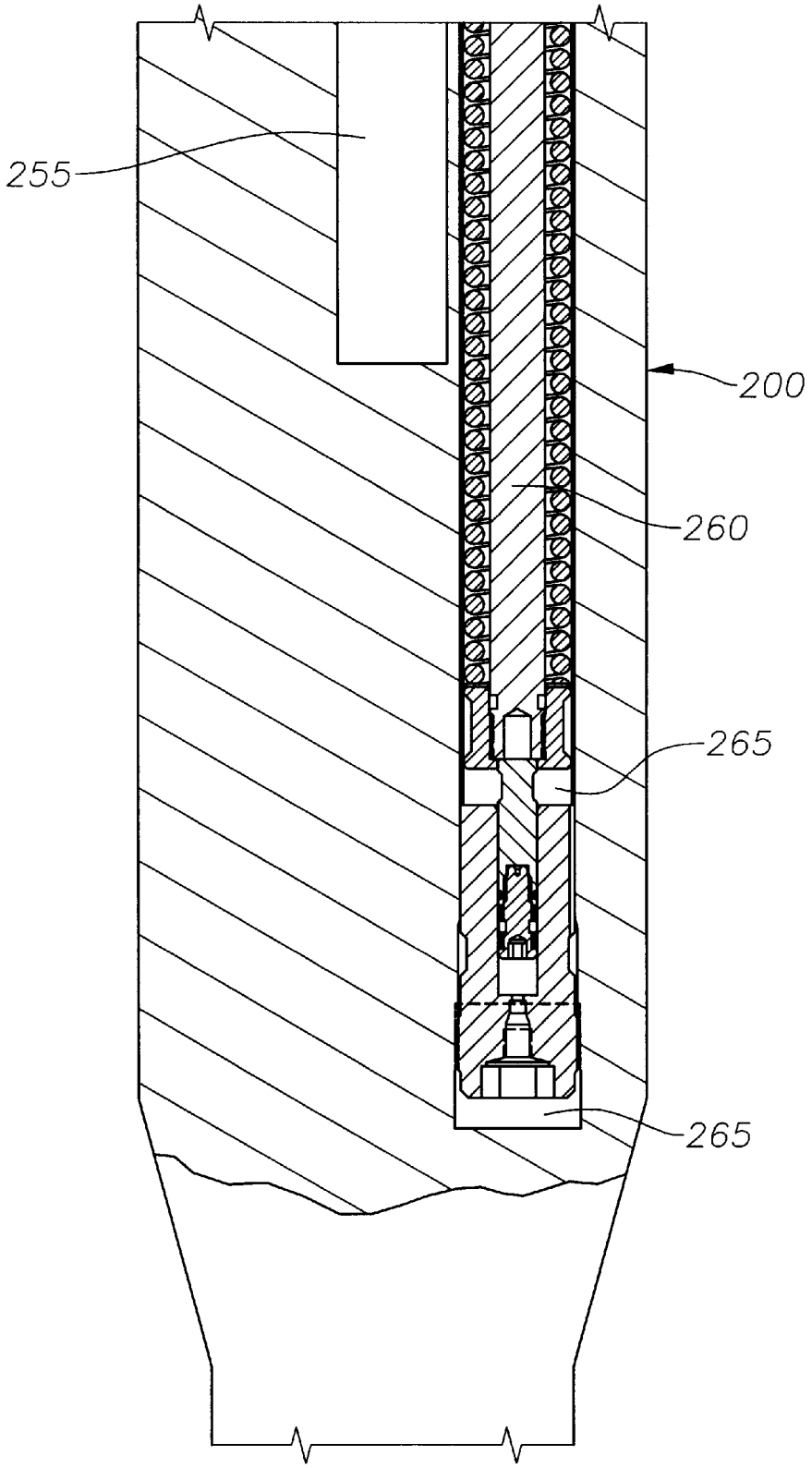

With reference now to FIG. 5, in operation, fluid measurement and control assembly 10 is shown connected to a string of tubing 50 and inserted into a well bore 500. Well bore 500 may be lined with a tubular casing 501 that extends from the surface down to at least one of a number of downhole regions such as producing geological formations A, B, C. Casing 501 may include perforations 71, 71', 71" in the region of each of at least one of the producing formations A, B, C to permit the flow of fluid from one or more of the formations A, B, C into the casing 501 lining the well bore 500. At least one packer 72, 72', 72" may be positioned about the tubing 50 above the desired producing formation A, B, C to define an upper limit to producing annulus region 502,502', 502" and formation A, B, C provided there below. A second packer 72, 72', 72" may also be positioned about the tubing 50 below the desired producing formation A, B, C to further define a lower limit to the desired producing annulus region 502, 502', 502", and formation A, B, C which is thereby provided between the first and second packer 72, 72', 72".

Fluid measurement and control assembly 10 of the present invention may be provided in a length of tubing 50 between the first and second packer 72, 72' so that it is in fluid communication with a first desired producing annulus region 502. Similarly, fluid measurement and control assembly 10' may be provided in the length of tubing 50 between the second and third packer 72', 72" so that it is in fluid communication with a second desired producing annulus region 502'. Production fluid from the desired producing formation A, B will thereby flow through perforations 71, 71' in the casing proximate the desired producing formation A, B and will flow into the desired producing annulus region 502, 502' and/or into a portion of tubing 50 downhole of packer 72" from desired producing formation C through perforations 71". Fluid from the desired producing formation A, B may thereafter flow through the desired fluid measurement and control assembly 10, 10', as described in detail hereafter so that the rate of flow from one or more of the producing formations, or production zones, A, B can be measured and controlled independently while maintaining flow through the production tubing from a downhole region such as downhole producing formation C.

Figure 8:
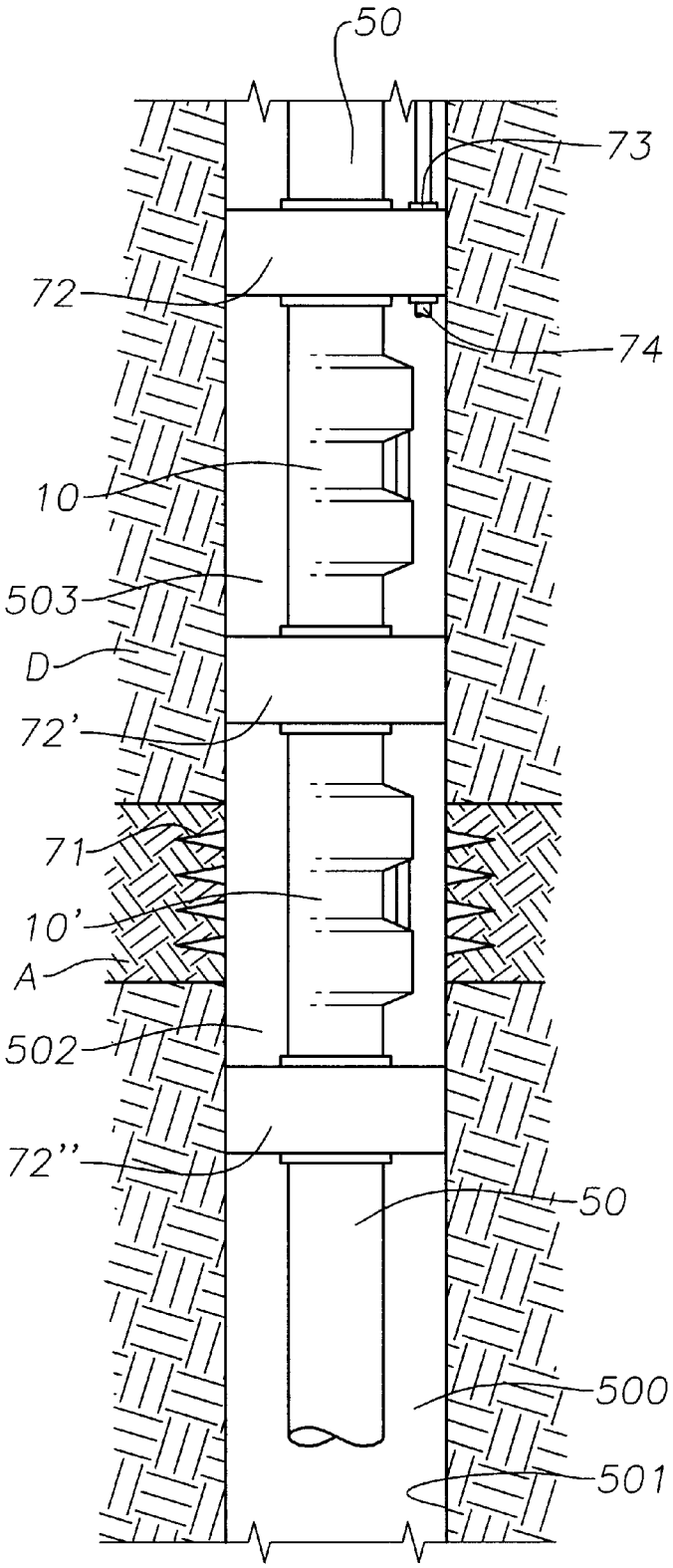
FIG. 8 is a schematic drawing of an alternative well completion system using a first fluid measurement and control assembly of the present invention to measure and control the flow rate of injection gas to a downhole gas-lift region while using a second fluid measurement and control device of the present invention to measure and control the flow rate of production fluid from a downhole producing geological formation.

With reference now to FIG. 8, the fluid measurement and control assembly 10, 10' of the present invention may also be used to measure and control the flow rate of gas or other fluids injected for artificial gas lift of the production fluid from a producing geological formation A or for other purposes. In such an embodiment, a first fluid measurement and control assembly 10 of the present invention can be a gas lift fluid measurement and control assembly 10, which is connected to a string of tubing 50 and inserted into a well bore 500 having a first packer 72 positioned about a portion of the tubing 50 uphole of the gas lift fluid measurement and control assembly 10. First packer 72 may be provided with a conduit 73 therethrough for receiving gas lift conduit 74. A second packer 72' may be positioned about a portion of the tubing 50 downhole of gas lift fluid measurement and control assembly 10 and preferably but not necessarily uphole of a desired producing geological formation A to define a non-producing gas lift annulus region 503 within the well bore casing 501 and between the first and second packers 72, 72', respectively, which may be proximate a non-producing geological formation D.

A second fluid measurement and control assembly 10' of the present invention can be a production fluid measurement and control assembly 10', which may be similarly provided either uphole or downhole of gas lift measurement and control assembly 10. Where production fluid measurement and control assembly 10' is provided downhole (as shown) from gas lift fluid measurement and control assembly 10', a third packer may be provided downhole of the desired producing geological formation A to define a producing annulus region within well bore casing 501, having perforations therein in fluid communication with producing geological formation A, and between the second and third packers 72', 72", respectively. In operation, production fluid from desired producing formation A will flow through perforations 71 in the casing proximate the desired producing formation A, and will flow into the desired producing annulus region 502. Fluid from desired producing formation A may thereafter flow through production fluid measurement and control assembly 10', as described in detail hereafter, so that the rate of production fluid flow from one or more of the producing formations A can be measured and controlled.

In such an embodiment, where artificial gas lift is desired, such as where the production fluid flow through production fluid measurement and control assembly 10' decreases below desired levels, gas lift fluid may be provided through gas lift conduit 74, through non-producing gas lift annulus region 503, through gas lift fluid measurement and control assembly 10, and into tubing 50 to assist the production fluid flow rate within tubing 50. The precise amount of gas lift fluid provided to assist the production fluid flow rate can, thereby, be measured and controlled to provided the optimum amount of gas lift while independently monitoring the production fluid flow rate using production fluid measurement and control assembly 10'.

With reference now to FIG. 6 and FIGS. 7A–7J, a preferred embodiment of the fluid measurement and control assembly 10 is shown and described in detail with side pocket mandrel 100 and side pocket mandrel 200 provided within a single tool. Central bore 105, 205 of side pocket mandrel 100 and side pocket mandrel 200 are not shown. Side pocket 101 is shown with components 150, 160, and 170 disposed within side pocket bores 145, 155, and 165 thereof. Similarly, side pocket 201 is shown with components 250, 260, and 270 disposed within side pocket bores 245, 255, and 265 thereof. The embodiment shown in FIG. 4 and FIGS. 5A–5K utilize a single mandrel orienting sleeve 20, for use with wireline kickover tool as previously described.

FIGS. 7A–7J together depict a semidiagrammatic cross section of a fluid measurement and control assembly 10 of the present invention shown in an opened position. In particular, FIGS. 7H–7I together depict variable orifice valve 250, illustrating: a valve body 450 with a longitudinal bore 451, an adjustable valve 452 in the body 450 which alternately permits, prohibits, or throttles fluid flow into said body 450 through fluid entry ports 210 provided in the side pocket mandrel 200 and out of said body 450, through flow-through port 89 provided in the body 450 of fluid control device 250, through flow-through channel 88 provided in side pocket mandrel 200, which is in fluid communication with side pocket bore 255, and into first side pocket bore 255. Further illustrated is power control unit 260, the construction and operation of which is described in detail in co-pending patent application Ser. No. 09/037,309. In general, when it is operationally desirable to open the variable orifice valve 250, hydraulic pressure is applied from a hydraulic pressure source (not shown), which causes valve actuator 230 to selectively and variably adjust between uphole and downhole positions to selectively open and close variable orifice valve 250, which is operatively connected thereto. The variable orifice valve 250 may be stopped at intermediate positions between fully open and fully closed to adjust the flow of fluid therethrough.

Variable orifice valve 250 may include a carbide stem 401 and seat 402 to effectively prevent fluid flow through the variable orifice valve 250 when the variable orifice valve 250 is in the fully closed position. The variable orifice valve 250 may also be provided with one-way check valve 453 to prevent any fluid flow from second side pocket bore 255 into variable orifice valve 250. Variable orifice valve 250 may also be provided with a latch 216, or other conventional wireline retrieval fitting 216 so the valve may be remotely installed and/or retrieved by well known wireline or coiled tubing intervention methods.

With variable orifice valve 250 in its open position (as shown), fluid is permitted to flow through fluid entry ports 210, through longitudinal bore 451, through flow-through port 89, through flow-through channel 88, and into flow conduit 240, which may be provided with straightening vance 57 therein, which may assist in providing laminar flow through flow conduit 240 for communication with fluid measurement device 160. Flow conduit 240 is provided in fluid communication with first side pocket 245 of side pocket mandrel 200 and with venturi 140 disposed within side pocket 145 of side pocket mandrel 100. Second straightening vane 56 may be provided inline with flow conduit 240 and proximate venturi 140 to further reduce flow disturbances in the fluid flowing through and measured by venturi 140. Flow conduit 240 and venturi 140 may be provided with a stem and seat or other conventional fitting to prevent or minimize fluid leakage as the fluid flows into and through venturi 140 and is measured as previously described herein. Fluid is permitted to continue flowing through venturi 140, through passageway 300, through side pocket bore 145 of side pocket mandrel 100, and into central bore 105 of side pocket 100 to be carried through central bore 55 of tubing 50 to the surface wellhead for recovery and storage and/or transport.

It should be noted that the preferred embodiments described herein employ a well known valve mechanism generically known as a poppet valve to those skilled in the art of valve mechanics. It can, however, be appreciated that several well known valve mechanisms may obviously be employed and still be within the scope and spirit of the present invention. Rotating balls or plugs, butterfly valves, rising stem gates, and flappers are several other generic valve mechanisms which may obviously be employed to accomplish the same function in the same manner. Similarly, other devices can be used for any of the components of the fluid measurement and control assembly.

Whereas the present invention has been described in particular relation to the drawings attached hereto, it should be understood that other and further modifications, apart from those shown or suggested herein, may be made within the scope and spirit of the present invention. Accordingly, the invention is therefore to be limited only by the scope of the appended claims.

We claim:

1. A downhole fluid measurement and control assembly, comprising:

a fluid measurement device, adapted to be located downhole within at least one side pocket bore of at least one side pocket mandrel connected to a length of downhole production tubing; and a fluid control device, adapted to be operatively connected and responsive to the fluid measurement device and at least a portion of the fluid control device is also adapted to be located downhole within the at least one side pocket bore of the at least one side pocket mandrel.

2. The assembly of claim 1, wherein the fluid measurement device includes a flow rate measurement device for measurement of the rate of fluid flow within the length of downhole production tubing.

3. The assembly of claim 2, wherein the flow measurement device includes a venturi.

4. The assembly of claim 2, wherein the flow measurement device includes a venturi and a differential pressure transducer.

5. The assembly of claim 4, wherein the venturi is locatable within a first side pocket bore of at least one side pocket mandrel and the differential pressure transducer is locatable in a second side pocket bore of the side pocket mandrel.

6. The assembly of claim 5, wherein the flow measurement device further includes a static pressure transducer.

7. The assembly of claim 6, wherein the static pressure transducer is integral with the differential pressure transducer.

8. The assembly of claim 6, wherein the static pressure transducer is locatable within a third side pocket bore of the at least one side pocket mandrel.

9. The assembly of claim 1, wherein the fluid control device includes a variable orifice valve.

10. The assembly of claim 9, wherein the fluid control device further includes an actuating means connected to the variable orifice valve.

11. The assembly of claim 1, further comprising at least one flow conduit in fluid communication with both the fluid measurement device and the fluid control device.

12. The assembly of claim 1, further comprising a plurality of flow conduits in fluid communication with both the flow measurement device and the flow control device.

13. The assembly of claim 11, wherein the at least one flow conduit is at least partially located within the at least one side pocket bore in which the fluid measurement device is located.

14. The assembly of claim 11, wherein the at least one flow conduit is at least partially located within the at least one side pocket bore in which the fluid control device is located.

15. The assembly of claim 12, wherein at least one of the plurality of flow conduits is at least partially located within the at least one side pocket bore in which the fluid measurement device is located.

16. The assembly of claim 12, wherein at least one of the plurality of flow conduits is at least partially located within the at least one side pocket in which the fluid control device is located.

17. A down hole fluid measurement control assembly, comprising:

a first mandrel having at least one side pocket;

a second mandrel having at least one side pocket;

a fluid measurement device disposed within the at least one side pocket of the first mandrel and including a flow rate measurement device having a venturi;

a fluid control device disposed within the at least one side pocket of the second mandrel; and at least one flow conduit in fluid communication with both the side pocket of the first mandrel and the side pocket of the second mandrel.

18. The assembly of claim 17, wherein the first and second mandrels are integral.

19. The assembly of claim 17, wherein the first and second mandrels are discrete from one another.

20. A combination downhole fluid measurement and control system, comprising:

a first side pocket mandrel, connected to a length of downhole production tubing;

a second side pocket mandrel, connected to the length of downhole production tubing;

a fluid measurement device, disposed within the first side pocket mandrel and including a flow rate measurement device for measurement of the rate of fluid flow within the length of downhole production tubing, the flow measurement device including a venturi;

a fluid control device, disposed within the second side pocket mandrel; and a flow conduit connected to and in fluid communication with both the fluid control device and the fluid measurement device.

21. The system of claim 20, wherein the fluid measurement device is wireline retrievable.

22. The system of claim 20, wherein at least a portion of the fluid control device is wireline retrievable.

23. The system of claim 20, wherein at least a portion of the fluid measurement device is located within at least one side pocket bore of the first side pocket mandrel.

24. The system of claim 20, wherein at least a portion of the fluid control device is located within at least one side pocket bore of the second side pocket mandrel.

25. The assembly of claim 20, wherein the flow measurement device further includes a differential pressure transducer.

26. The assembly of claim 25, wherein the venturi is locatable within a first side pocket bore of at least one side pocket mandrel and the differential pressure transducer is locatable in a second side pocket bore of the side pocket mandrel.

27. The assembly of claim 26, wherein the flow measurement device further includes a static pressure transducer locatable within a third side pocket bore of the at least one side pocket mandrel.

28. The assembly of claim 20, wherein the fluid control device includes a variable orifice valve.

29. The assembly of claim 28, wherein the fluid control device further includes an actuating means connected to the variable orifice valve.

30. The assembly of claim 20, wherein the first and second side pocket mandrel are integrally formed within a single downhole tool.

31. The assembly of claim 20, wherein the flow conduit includes at least one straightening vane provided inline therewith.

32. A fluid measurement and control system for simultaneous measurement and control of fluid flow through a string of tubing from discrete production zones of a multiple completion production well, comprising:

a first packer provided about the tubing at a location generally associated with an upper boundary of a first discrete production zone;

a second packer provided about the tubing at a location generally associated with a lower boundary of the first discrete production zone;

a first fluid measurement and control assembly connected inline with the tubing at a location between the first and second packers, the assembly having wireline retrievable side pocket locatable fluid measurement and control components, the fluid measurement component including a venturi; and a second fluid measurement and control assembly connected inline with the tubing at a location associated with a second discrete production zone, the assembly having wireline retrievable side pocket locatable fluid measurement and control components, the fluid measurement component including a venturi.

33. The fluid measurement and control system of claim 32, further comprising:

a third packer provided about the tubing at a location generally associated with an upper boundary of the second discrete production zone;

a fourth packer provided about the tubing at a location generally associated with a lower boundary of the second discrete production zone; and wherein the second fluid measurement and control assembly is located inline with the tubing at a location between the second and third packers.

34. A method of measuring and controlling the rate of fluid flow within a length of downhole production tubing having a central bore, comprising the steps of:

providing at least a first side pocket mandrel and a second side pocket mandrel within the length of downhole production tubing, each first and second side pocket mandrel having at least a central bore, a first side pocket bore, and a second side pocket bore;

providing a flow conduit between the first and second side pocket mandrel;

providing a fluid flow measurement device within at least one of the first or second side pocket bores of the first side pocket mandrel and in fluid communication with the flow conduit;

providing a fluid control device within at least one of the first or second side pocket bores of the second side pocket mandrel and in fluid communication with the flow conduit;

measuring the fluid flow rate with the fluid flow measurement device;

generating a control signal in response to the fluid flow rate; and in response to the control signal, controlling the rate of flow through the fluid control device.

35. The method of claim 34, wherein the fluid measurement device is in fluid communication with the central bore of the production tubing and wherein the fluid control device is in fluid communication with a producing geological formation.

36. The method of claim 35, wherein the fluid measurement device includes a venturi and wherein the fluid control device includes a variable orifice valve.

37. The method of claim 36, wherein the fluid measurement device further includes a differential pressure transducer in fluid communication with the venturi.

38. The method of claim 37, wherein the fluid measurement device further includes a static pressure transducer.

39. The method of claim 38, wherein the static pressure transducer and differential pressure transducer are formed integrally with one another to comprise a single device located in the same side pocket bore.

40. The method of claim 38, wherein the static pressure transducer and differential pressure transducer are each located in a different side pocket bore.

41. The method of claim 38, wherein the fluid control device further includes a power source operably connected to the variable orifice valve for selectively varying the orifice size of the variable orifice valve in response to the control signal.

42. A combination wireline retrievable, side pocket locatable, downhole fluid measurement and control system, comprising:

a first side pocket mandrel, connected to a length of downhole production tubing;

a second side pocket mandrel, connected to the length of downhole production tubing;

a wireline retrievable venturi, disposed within a first side pocket bore of the first side pocket mandrel;

a wireline retrievable differential pressure transducer, disposed within a second side pocket bore of the first side pocket mandrel;

a wireline retrievable static pressure transducer, disposed within a third side pocket bore of the first side pocket mandrel;

a wireline retrievable variable orifice valve, having at least an open and closed position and being disposed within a second side pocket bore of the second side pocket mandrel and in fluid communication with a production formation;

a power source, disposed within a third side pocket bore of the second side pocket mandrel;

a flow conduit, disposed within a first side pocket bore in fluid communication between the venturi and the variable orifice valve; and the venturi being in fluid communication with the central bore of the production tubing and in fluid communication with the differential pressure transducer, whereby, when the variable orifice valve is in its open position, fluid flow between the central bore of the production tubing and the production formation must flow through the variable orifice valve, through the flow conduit, through the venturi, and into the central bore of the production tubing.

43. A method of measuring and controlling, in a string of tubing in a well bore, a first fluid flow rate associated with fluid in a first downhole region, while maintaining, in the string of tubing, a second fluid flow rate associated with fluid in a second downhole region, comprising the steps of:

providing a wireline retrievable, side pocket locatable, fluid measurement and control assembly, the assembly including a fluid measurement device including a venturi;

connecting the fluid measurement and control assembly to the string of tubing proximate a length of the string of tubing associated with the first downhole region;

providing a first packer, positioned about the length of tubing uphole of the first downhole region;

providing a second packer, positioned about the length of tubing downhole of the first downhole region, whereby an annulus region is formed between the first and second packer;

permitting fluid flow through a central bore of the tubing at a length of the tubing associated with the second downhole region;

measuring and controlling the fluid flow from the first downhole region into the annulus region and through the fluid measurement and control assembly independent from the flow through the tubing from the second downhole region; and permitting fluid flow from the fluid measurement and control assembly to flow through the central bore of the tubing.

44. The method of claim 43, wherein the first downhole region is a desired producing geological formation and the second downhole region is a desired producing geological formation.

45. The method of claim 43, wherein the first downhole region is associated with a gas lift conduit, the annulus region is a non-producing gas lift annulus region, and the second downhole region is a desired producing geological formation.

* * * * *